US005700061A

United States Patent [19]

Merten et al.

[11] Patent Number: 5,700,061

[45] Date of Patent: Dec. 23, 1997

[54] GUIDE AND DRIVE ARRANGEMENT FOR THE WINNING MACHINES OF MINERAL WINNING INSTALLATIONS

[75] Inventors: Gerhard Merten; Frank Fischer, both of Lünen, Germany

[73] Assignee: DBT Deutsche Bergbau-Technik GmbH, Germany

[21] Appl. No.: 632,110

[22] Filed: Apr. 15, 1996

[30] Foreign Application Priority Data

Aug. 30, 1995 [DE] Germany ..... 195 31 808.0

[51] Int. Cl.[6] ..... E21C 29/02

[52] U.S. Cl. ..... 299/43; 105/29.1

[58] Field of Search ..... 299/43, 34.1; 105/29.1

[56] References Cited

U.S. PATENT DOCUMENTS

| | | | |
|---|---|---|---|
| 4,372,619 | 2/1983 | Braun | 299/43 |
| 4,501,447 | 2/1985 | Tatton et al. | 299/43 |
| 5,161,858 | 11/1992 | Braun et al. | 299/43 |
| 5,547,262 | 8/1996 | Braun et al. | 299/43 |
| 5,580,135 | 12/1996 | Braun et al. | 299/43 |

FOREIGN PATENT DOCUMENTS

| | | |
|---|---|---|
| 2914861 | 10/1980 | Germany . |
| 3639133 | 5/1988 | Germany . |
| 4234282 | 4/1994 | Germany . |
| 9403731 | 7/1994 | Germany . |
| 4423925 | 11/1996 | Germany . |

*Primary Examiner*—David J. Bagnell
*Attorney, Agent, or Firm*—Vickers, Daniels & Young

[57] ABSTRACT

A mineral winning installation employs a shearer which is moved along a scraper-chain conveyor compound of individual pans mounted end-to-end. the shearer extends over the conveyor and is guided by guides provided at both sides of the conveyor. The body of the shearer has a driven chain wheel which meshes with an open-link chain serving as a rack abutment and laid on a bed alongside the side walls of the conveyor pans adjacent the mineral face. The side walls of the pans have upper and lower flanges which have strip-like projections directly outwardly from the pans. The chain is retained by the strip-like projections of the upper flanges of the pan side walls which overlap one side of the horizontal links and detachably hold-down strips which overlap the other side of the horizontal links. the hold-down strips are mounted for swivelling to release the chain links are detachably mounted to the support bars fixed to the support members.

39 Claims, 2 Drawing Sheets

GUIDE AND DRIVE ARRANGEMENT FOR THE WINNING MACHINES OF MINERAL WINNING INSTALLATIONS

FIELD OF THE INVENTION

The present invention relates in general to mineral winning installations and more particularly to installations with a winning machine which moves above a scraper-chain conveyor disposed alongside a mineral face.

BACKGROUND OF THE INVENTION

A mineral, e.g. coal, winning installation with a machine, such as a drum or disc shearer, which extends over a scraper-chain conveyor needs to employ a guide and drive arrangement for the machine. Guide and drive arrangements are known in a variety of constructions. For example, it is known to drive the machine with the aid of a rotatable chain or pin wheel which is mounted on the body of the winning machine and which meshes with a chain serving as a rack abutment laid on a bed which is open from above and which is defined by components fitted to the channel sections or pans of the conveyor at the goaf or stowage side remote from the mineral face. The components also provide guide rails for guiding the machine. U.S. Pat. No. 4,372,619 describes a guide and drive arrangement of this known type.

As to the construction of the scraper-chain conveyor, again it is well known to employ a series of individual channel sections or pans interconnected in end-to-end relationship to resist tensile force but to permit some angular mobility in horizontal and vertical senses. Each pan is composed of a pair of generally sigma-shaped side walls with a floor plate welded therebetween. A scraper chain assembly is then circulated along the pans in upper and lower runs above and below the floor plates. It is also known from DE-4234282 to extend the upper and lower flanges of the side walls of the pans, which normally just project inwardly towards one another, in the outward direction to form strips. Plates or brackets welded between these strips can then be used to affix attachments to the side walls.

DE-P4423925.4 describes a construction where brackets are fixed to the goaf side walls of the conveyor pans and provide a channel for receiving the chain serving as the rack abutment for the drive chain wheel. This channel is closed off at the side nearest the conveyor with hook-like guide rails arranged end-to-end around which engage with guide shoes provided on the machine body.

In another known construction, described in DE-GM 9403731, guide beams are fixed to the side walls of the conveyor pans to define the bed for the chain used as the rack abutment for the drive chain wheel. Guide strips are screwed onto the guide beams and are enclosed by guide shoes of the machine body which run along a laterally open guide channel. These guide strips also extend partly over the horizontal links of the chain to maintain the chain on the bed. The chain is positioned in the bed outwardly from the side walls of the pans at about the same level as the upper flanges of the side walls whilst the guide channel lies below the chain bed and has a relatively narrow cross-section. Fine dust, particularly coal dust can accumulate in the guide channel and when moist forms hard brickettes which can block the guide channel and damage the installation.

Instead of employing a guide and drive arrangement on the goaf side of the installation it is known to provide the chain serving as the rack abutment for the chain wheel on the mineral face side and to guide the machine on the opposite goaf side with the aid of skids engaging on guide rail attachments on the conveyor pans. German specification DE2914861and DE3639133describes arrangements of this type.

A general object of the present invention is to provide an improved guide and drive arrangement which is more compact and less complicated than known designs.

A further object of the present invention is to provide a guide and drive arrangement in which the chain serving as the rack abutment is in a low position yet close to the conveyor pans and in which guidance of the machine is improved.

SUMMARY OF THE INVENTION

According to one aspect of the present invention a guide and drive arrangement for use in a mineral winning installation of the type discussed above comprises first and second guides disposed adjacent both sides of the conveyor; and a bed or channel defined adjacent one of the guides which is open from above and serves to receive a chain which serves as a rack abutment for a driven chain wheel mounted on the machine; wherein the channel is delimited from above by means of detachably hold-down strips and by means of the strip projections of the upper flanges of the side walls of the pans adjacent the channel which extend over the arms of horizontal links of the chain and the channel for the chain is disposed below the upper flanges of the side walls of the pans adjacent the channel.

It is preferable for the chain channel to be located on the side of the conveyor adjacent the mineral face.

In a guide and drive arrangement according to the invention, the chain for receiving the drive chain wheel or pin wheel is located in the low position close beside the side walls of the conveyor pans so that a compact construction can be achieved with good machine guidance during mineral extraction. The flange strip projections formed in one piece on the upper flanges of the side walls of the conveyor pans and which extend along the side walls are used as stationary holding-down strips for the chain located in the chain channel, thus also providing structural simplification. The arrangement may advantageously be such that on each the conveyor pans of the scraper chain conveyor and between the retaining strip projections located on the upper and lower flanges of the side walls, reinforcing or packing plates are fixed, preferably by welding. The upper end regions of the plates located below the retaining strips of the upper flanges forming the holding-down means may possess notch or groove-like recesses, which serve for supporting the vertical chain links. The packing plates can alternatively be constructed in the manner of brackets which are provided in known manner with screw bolt pockets, which in the present case can be used for the screw connection of guide sections or support members thereof at least partly forming the chain channel. In this case, the support members may have upstanding walls provided with the grooves for receiving the vertical chain links. The packing plates are in this case still an important component of the chain channel and of the chain bed and the plates may be recessed to accommodate the inner arms of the chain links overlapped by the flange strip projections The other releasable holding-down strips opposite the flange strips projections facilitate the insertion or removal of the rack abutment chain. These strips engage over the outer arms of the horizontal chain links and are appropriately releasably connected e.g. to the support members, for example by screwing. The arrangement may advantageously also be such that the outer releasable holding-down strips are mounted on the support bars so that they can be swung outwards for opening the chain channel.

The winning machine on the side of the drive is supported so that it is able to roll by means of one or more rolling elements such as support wheels engaging on the upper flanges of the side walls of the conveyor pans. In this respect it is advantageous that the side walls are widened by the said flange strip projections on their upper flanges and at the same time reinforced by the said packing plates or brackets.

The driven chain wheel on the winning machine which engages from above in the chain channel and thus in the horizontal chain links can be located at a short lateral distance from the support wheel. In this case the possibility also exists of connecting the support wheel and the chain wheel to form one structural unit. It is also recommended to mount the support wheel and the chain wheel so that they are free to move at least in the lateral direction, thus in a floating manner, on the machine body of the winning machine, so that the support wheel and the chain wheel are able to be adapted freely to the curvature of the scraper chain conveyor and unevenness in the vertical sense.

The guide on the side of the scraper chain conveyor opposite the drive side, preferably on the goal side thereof, can be composed of guide rails located on supports attached to the upper flanges of the side walls of the conveyor pans. In this case the arrangement is appropriately such that these guide rails serves primarily for the lateral guidance of the winning machine. On the opposite drive side, i.e. preferably on the mineral face side of the scraper chain conveyor, where the winning machine is supported to roll by the support wheel on the flanges of the side walls of the conveyor pans, the winning machine can be guided by means of one or more guide shoes which engage in a guide channel beneath the chain channel. Such a guidance serves primarily to secure the engagement of the chain wheel in the chain and prevent lift-off. The guide channel can be relatively large in cross-section and the guide shoe L-shaped with a portion projecting laterally into the guide channel.

Since, in this case, a hook guidance is dispensed with, the or each guide shoe thus engages solely by a horizontal guide arm projection from the side in the guide channel. No accumulations and formations of brickettes by penetrating fine coal may occur in the guide channel. On the contrary, during the extraction work, any accumulations are pushed laterally by the guide shoe out of the guide channel.

According to a further feature of the invention, the support members allocated to the conveyor pans are supported on the floor by foot plates located below the lower flanges of the conveyor pan side walls. These foot plates are appropriately provided on their face-side ends with bevels or the like forming scrapers. The machine weight is thus in this case transferred to the floor by way of the side walls of the channel pans and the foot plates. The support members can have individual support bars connected to web-like ribs of the support members.

The web-like ribs of the support members are spaced apart in the longitudinal direction of the conveyor to form dirt outlet channels, from which fine coal or dust penetrating the chain channel may flow downwards. The support members with the web-like fibs may be supported laterally on the packing plates welded to the side walls of the conveyor pans, are appropriately constructed so that for each such member the web-like ribs in the lower region terminate at a continuous support neck carrying the associated foot plate. This support neck closes off for each conveyor pan, the guide channel serving for the engagement of the guide shoe, towards the conveyor side. The guide channel can be formed on each conveyor pan between the foot plate or between the floor of the working when the foot plate does not have a significant width and the support bars located at a distance there above. On the inside defined by the support neck of the support members and the web-like ribs, the channel may have an inclined surface producing a trapezoidal cross-section.

According to another aspect of the present invention a guide and drive arrangement comprises first and second guides disposed adjacent both side walls of the conveyor and a channel defined adjacent one of the guides which is open from above and serves to receive a chain which acts as a rack abutment for a driven chain wheel mounted on the machine; wherein the channel is defined in a position below the upper flanges of the side walls of the pans adjacent the channel, the machine has at least one rolling element supported for running contact with the upper surfaces of the upper flanges of the side walls of the pans adjacent the chain channel and an L-shaped guide shoe which engages in a laterally open guide channel formed below the chain channel to maintain the rolling element on the upper surfaces.

The invention may be understood more readily and various other aspects and features of the invention may become apparent from consideration of the following description:

BRIEF DESCRIPTION OF THE DRAWINGS

Embodiments of the invention will now be described, by way of examples only, with reference to the accompanying drawings wherein.

DESCRIPTION OF PREFERRED EMBODIMENTS

Figure 1:
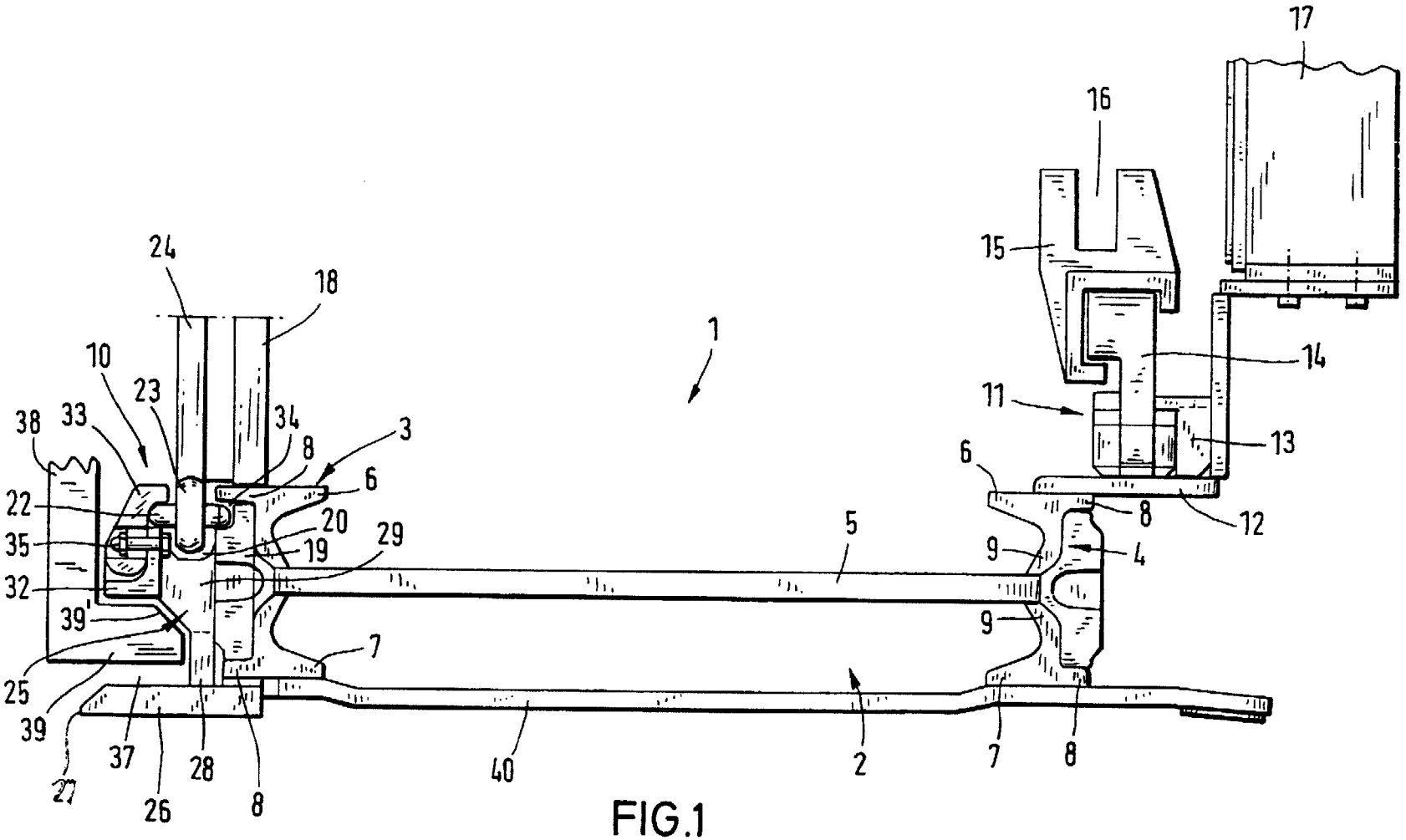
FIG. 1 is a schematic end view of part of a mineral mining installation constructed in accordance with the invention and FIG. 2 is a schematic end view of part of a modified installation constructed in accordance with the invention and taken on a somewhat larger scale to FIG. 1.
Figure 2:
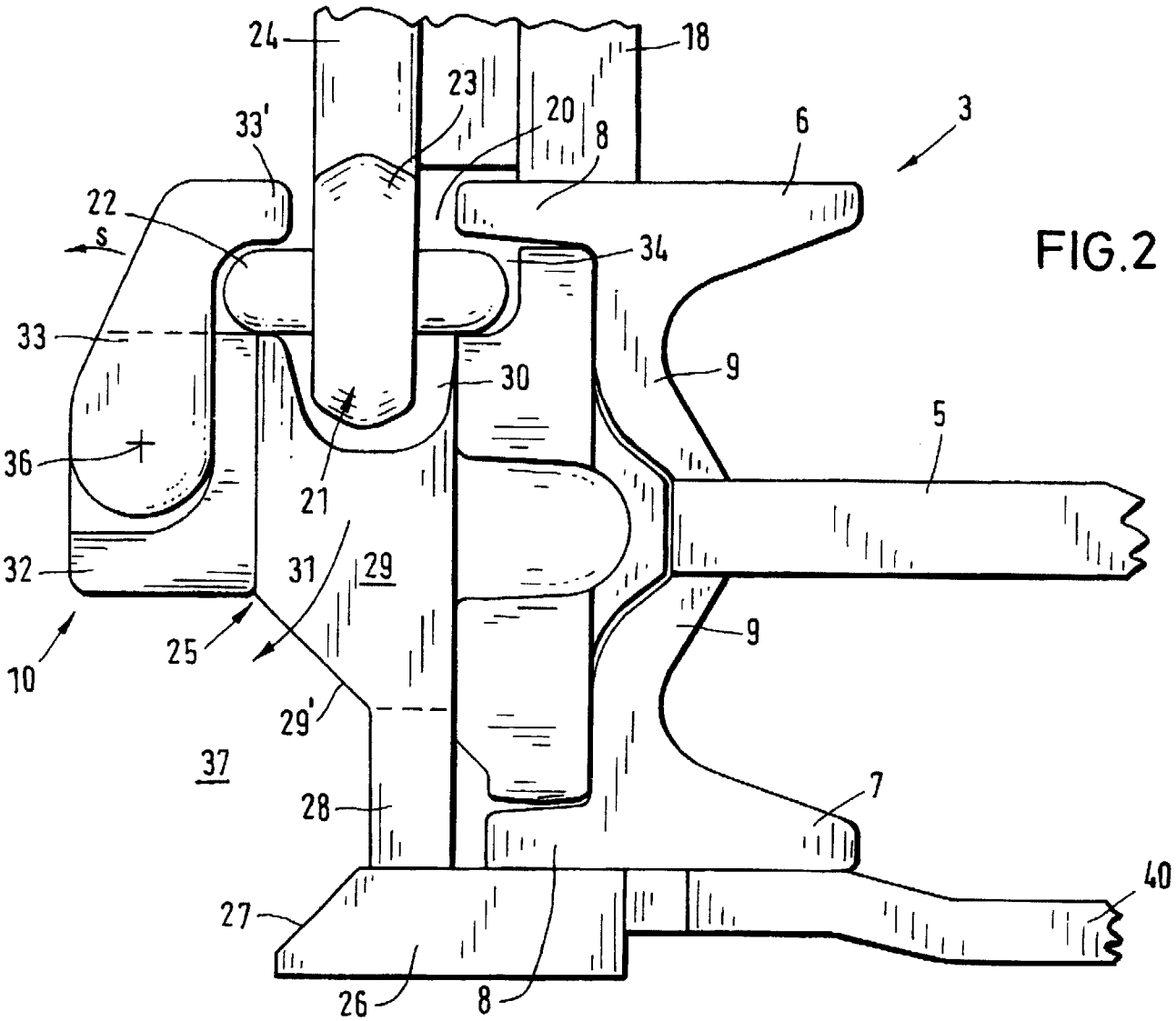

As represented in FIG. 1, and also FIG. 2 to a large extent, a mineral mining installation used for winning mineral ore, particularly coal, employs a scraper chain conveyor 1 laid alongside the mineral, e.g. coal, face. As is known, the conveyor 1 is composed of a series of individual channel sections or pans 2 each composed of side walls 3,4, adjoined by a floor plate 5. The pans 2 are interconnected to resist tension force longitudinally of the conveyor yet to permit some limited mobility in horizontal and vertical senses between the pans 2. A winning machine—only shown in part—serves to strip mineral from the working face (not shown but to the left of the Figures) as the machine is propelled back and forth along the conveyor 1. The winning machine is of the shearer type—particularly a drum or disc shearer—which is guided on both sides of the conveyor 1 and extends over the conveyor in the manner of a portal. Such machines and the means for driving such machines and their manner of guidance is well known.

A scraper chain assembly (not shown) is circulated along the conveyor pans 2 and serves to displace mineral stripped from the mineral face by the winning machine.

A guide 10 serves to guide the machine along the mineral face side of the conveyor 1 whilst a guide 11 serves to guide the machine along the goaf or stowage side of the conveyor 1. Each guide 10,11 is composed of individual guide rail sections attached to the pans 2 of the conveyor 1.

The side walls of the pans 2 of the conveyor have upper and lower horizontal flanges 6,7 each with outwardly extending strip projections 8. Support brackets 12 are attached as by welding to the upper flanges 6 of the goal side walls 4. The brackets 12 carry a conduit 17 in which an electrical cable used for providing operating power to the machine is accommodated. The brackets 12 also provide mountings 13 for the guide rails making up the guide 11. These guide rails have rectangular head pieces 14 which fit with one or more guide skids 15 of the machine. The machine may employ two such guide skids 15 spaced apart along the machine and the conveyor 1. Preferably the skids 15 are mounted on the body of the winning machine for swivelling around horizontal axes and the reference mineral 16 generally includes the coupling joint between the skids 15 and the machine body.

On the mineral face side the machine is supported directly on the upper flanges 6 of the side walls 3 of the conveyor pans 2.

More particularly, the machine can have sliding or more preferably rolling elements such as wheels 18 which contact the upper flanges 6. Reinforcing or packing plates 19 are welded between the strips 8 of the flanges 6,7 of the mineral face side wails 3 of the pans 2 to impart rigidity to these walls 3 and to provide pockets for receiving bolts or nuts used to secure other fitments to the conveyor 1.

Multi-part support members 25 provide a bed and define a channel 20 for receiving an oval-link chain 21 serving as an abutment rack for a driven chain or pin wheel 24 which extends into the channel 20 to mesh with horizontal links 22 of the chain 21 therein. The vertical links of the chain 21 are designated 23 and co-operate with the teeth or pins of the wheel 24 to guide these projecting elements into the horizontal links 22. As shown in FIG. 1, the there-represented chain wheel 24 and the support wheel 18 are spaced apart by a short distance and these components can be mounted on the same axle or even combined as one integral component. It is of course possible to have several chain wheels 24 to correspond with the support wheels 18.

Each support member 25 is attached to an associated packing plate 19. Each member 25 has a foot plate 26 which engages beneath the lower flange 7 of the side wall 3 of the associated pan 2 and rests on the floor of the mine working. The foot edge of the foot plate 26 is bevelled as at 27 to create a scraping edge. The foot plate 26 is attached to an upstanding lower neck or bar 28 which bears a series of spaced-apart web-like ribs 29. The ribs 29 engage on the associated packing plate 19 and have trough-like recesses 30 for receiving the vertical chain links 23. The gaps between the ribs 29 enable dust and like material which would otherwise accumulate in the channel 20 to escape in the direction of arrow 31 in FIG. 2.

The ribs 29 are attached to a support bar 32 remote from the associated packing plate 19 and this bar 32 has a hook-like holding-down strip 33. The strip 33 hooks around the outermost arms of the horizontal links 22 of the chain 21. The innermost arms of the horizontal links 22 of the chain 21 fit into a groove-like recess 34 provided at the outer edge of the packing plate 19. The strips 8 of the upper flange 6 of the side wall 3 of the conveyor pan 2 extends over the innermost arms of the horizontal links 22 and act as a further retaining means to complement the hook-like strip 33 in holding the chain 21 down.

As shown in FIG. 1, the bar 32 is detachably fixed with the aid of bolts 35.

In the modified arrangement show in FIG. 2, the bar 32 supports a separate component 33 with a hook-like portion 33' fitting over the outer arms of the chain links 22 and the component 33 is pivotably mounted with a pivot joint 36 to the bar 32 for swivelling outwardly in the direction of arrows.

As shown in FIG. 1, a further guide channel 37 is established above the foot plate 26, below the bar 32 and laterally of the ribs 29 and the neck 28. At least one guide shoe 38 of L-shaped form engages in the guide channel 37 and is carried by the machine. The channel 37 has a generally trapezoidal cross-section. In the FIG. 2 arrangement the foot plate 26 is of reduced width relative to the FIG. 1 arrangement and the guide channel 27 is delimited below by the floor of the working. The inclined side faces 29' of the ribs 29 partly define the guide channel 37 in the same manner as in FIG. 1. As shown in FIG. 1, the or each guide shoe 38 has a leg 39 which projects into the channel 37 and engages around the bar 32 and the associated component 33. The leg 39 has a bevelled surface 39' which matches the side faces 29' of the ribs 29. The guide channel 37 has a relatively large trapezoidal cross-section and moreover the leg 39 does not grasp around the bar 32 in a hook-like manner but extends rectilinearly. Hence, fine dust which may accumulate in the channel 37, and may form brickettes when moist, does not impede the passage of the guide shoe 38.

In the FIG. 2 arrangement where the foot plate 26 are of reduced width any fine dust will tend to fail onto the floor of the mine working.

In general, the guide 11 at the goaf side of the installation serves for lateral guidance of the machine whilst the guide shoe or shoes 38 running along the guide channel 27 serve to hold the machine down to maintain engagement between the or each rolling wheel 18 and the upper surface of the flanges 6 and to maintain driving engagement between the or each drive chain wheel 24 and the chain 21. The contact forces between the wheel or wheels 18 and the flanges 6 are transferred through the side walls 3 of the pans 2 to the foot plates 26 resting on the floor of the working.

It is desirable to mount the axles of the wheels 24,18 for some mobility on the machine body so that the passage of the machine can cope with curvature of the conveyor 1 and any unevenness in the vertical direction.

As also represented in the drawings, the lower run of each pan 2 is closed off with a cover plate 40 welded between the lower flanges 7 of the side walls 3,4 and the entire installation is supported on the floor of the working by means of the foot plates 26 at the mineral face side and by cantilevered projections of the cover plates 40 at the goaf side.

We claim:

1. In a mineral winning installation which employs a scraper-chain conveyor composed of individual pans connected end-to-end, each pan being composed of shaped side walls with upper and lower flanges and a floor plate extending between the side walls, the upper and lower flanges of the side walls of each pan projecting inwardly towards one another and toward the floor plate and strip projections projecting outwardly from the flanges and away from the floor plate and a winning machine extending over the conveyor and movable along the conveyor; an improved guide and drive arrangement for the machine comprising first and second guides disposed adjacent both side walls of the conveyor; and a channel defined adjacent one of the guides which is open from above and serves to receive a chain which acts as a rack abutment for a driven chain wheel mounted on the machine; wherein the channel is delimited from above by means of detachably hold-down strips and by means of the strip projections of the upper flanges of the side walls of the pans adjacent the channel which extend over the arms of horizontal links of the chain and the channel for the chain is disposed below the upper flanges of the side walls of the pans adjacent the channel.

2. An installation according to claim 1, wherein the one guide defining the channel for the chain is disposed at the side of the installation nearest a mineral face.

3. An installation according to claim to 1, wherein reinforcement plates are fixed between the strip projections of the side walls of the pans adjacent the channel and support members are attached to the plates and have recesses at the upper ends which partly define the channel and receive vertical links of the chain.

4. An installation according to claim 3, wherein support bars are fitted to the support members and are disposed outwardly therefrom relative to the side walls of the pans adjacent the channel and the hold-down strips are detachable secured to the support bars.

5. An installation according to claims 4, wherein the hold-down strips are mounted for swivelling on the support bars and the hold-down strips can be released and swung outwardly to release the chains.

6. An installation according to claim 4, wherein the support members have web-like ribs spaced apart along the conveyor and the support bars are engaged with the ribs.

7. An installation according to claim 6, wherein the support members have foot plates extending below the lower flanges of the side walls of the pans adjacent the chain channel and resting on the floor of a mine working in which the installation is installed for operation and wherein the support bars are disposed above the foot plates.

8. An installation according to claim 7, wherein a laterally-open guide channel is defined by the support bars and the support members and the machine has at least one guide shoe which engages in the guide channel.

9. An installation according to claim 8, wherein the guide shoe is L-shaped with a portion extending transversely of the conveyor and projecting into the guide channel.

10. An installation according to claim 9, wherein the guide channel for the guide shoe is of trapezoidal cross-section and the portion of the guide shoe and the ribs have corresponding inclined surfaces which confront one another.

11. An installation according to claim 8, wherein the foot plates lie directly beneath the guide channel.

12. An installation according to claims 8, wherein the foot plates terminate inwardly of the guide channel and towards the side walls of the pans adjacent the chain channel.

13. An installation according to claim 6, wherein the support members and the support bars are connected to the reinforcement plates as units corresponding to the conveyor pans.

14. An installation according to claim 4, wherein the arms of the horizontal links of the chain rest on the support bars and on recessed upper portions of the reinforced plates.

15. An installation according to claim 3, wherein the support members have foot plates extending below the lower flanges of the side walls of the pans adjacent the chain channel and the foot plates rest on the floor of a mine working in which the installation is installed for operation.

16. An installation according to claim 15, wherein the foot plates have beveled edges remote from the side walls of the conveyor pans which form scrapers.

17. An installation according to claim 1, wherein the machine has at least one rolling element which engages on and is supported by the upper surfaces of the upper flanges of the side walls of the pans adjacent the chain channel.

18. An installation according to claim 17, wherein the chain wheel is offset by a small distance transversely of the conveyor from the rolling element.

19. An installation according to claim 18, wherein the chain wheel and the roll element are connected together or united as one integral compound.

20. An installation according to claim 1, wherein the other guide disposed on the side of the conveyor remote from the chain channel is composed of guide rails mounted on supports fixed onto the upper flanges of the side walls of the conveyor pans remote from the chain channel and the machine has one or more guide skids which engage with the guide rails.

21. An installation according to claim 1, wherein the channel is defined in a position below the upper flanges of the side walls of the pans adjacent the channel, the machine has at least one rolling element supported for running contact with the upper surfaces of the upper flanges of the side walls of the pans adjacent the chain channel and an L-shaped guide shoe which engages in a laterally open guide channel formed below the chain channel to maintain the rolling element of the upper surfaces.

22. In a mineral winning installation which employs a scraper-chain conveyor composed of individual pans connected end-to-end, each pan being composed of shaped side walls with upper and lower flanges and a floor plate extending between the side walls, the upper and lower flanges of the side walls of each pan projecting inwardly towards one another and toward the floor plate and strip projections projecting outwardly from the flanges and away from the floor plate and a winning machine extending over the conveyor and movable along the conveyor, an improved guide and drive arrangement for the machine comprising first and second guides disposed adjacent both side walls of the conveyor and a channel defined adjacent one of the guides which is open from above and serves to receive a chain which acts as a rack abutment for a driven chain wheel mounted on the machine, wherein the channel is defined in a position below the upper flanges of the side walls of the pans adjacent the channel, the machine has at least one rolling element supported from running contact with the upper surfaces of the upper flanges of the side walls of the pans adjacent the chain channel and an L-shaped guide shoe which engages in a laterally open guide channel formed below the chain channel to maintain the rolling element on the upper surfaces.

23. An installation according to claim 22, wherein the channel is delimited above by means of hold-down strips and by means of the strip projections of the upper flanges of the side walls of the pans adjacent the channel walls extends over the arms of the horizontal lines of the chain.

24. An installation according to claim 23, wherein reinforcement plates are fixed between the strip projection of the side walls of the pans adjacent the channel and support members are attached to the plates and have recesses at the upper ends which partly define the channel and receive vertical links of the chain.

25. An installation according to claim 24, wherein support bars are fitted to the support members and are disposed outwardly therefrom relative to the side walls of the pans adjacent the channel and the hold-down strips are detachable secured to the support bars.

26. An installation according to claim 25, wherein the hold-down strips are mounted for swivelling on the support bars and the hold-down strips can be released and swung outwardly to release the chain.

27. An installation according to claim 27, wherein the support members have web-like ribs spaced apart along the conveyor and the support bars are engaged with the ribs.

28. An installation according to claim 27, wherein the support members have foot plates extending below the lower flanges of the side walls of the pans adjacent the chain channel and resting on the floor of a mine working in which the installation is installed for operation and wherein the support bars are disposed above the foot plates.

29. An installation according to claim 28, wherein the foot plates lie directly beneath the guide channel.

30. An installation according to claim 28, wherein the foot plates terminate inwardly of the guide channel and towards the side walls of the pans adjacent the chain channel.

31. An installation according to claim 27, wherein the support members and the support bar are connected to the reinforcement plates as units corresponding to the conveyor pans.

32. An installation according to claim 25, wherein the arms of the horizontal links of the chain rest on the support bars and on recessed upper portions of the reinforcement plates.

33. An installation according to claim 24, wherein the support members have foot plates extending below the lower flanges of the side walls of the pans adjacent the chain channel and the foot plates rest on the floor of a mine working in which the installation is installed for operation.

34. An installation according to claim 33, wherein the foot plates have beveled edges remote from the side walls of the conveyor pans which form scrapers.

35. An installation according to claim 22, wherein the one guide defining the channel for the chain is disposed at the side of the installation nearest a mineral face.

36. An installation according to claim 22, wherein the chain wheel is offset by a small distance transversely of the conveyor from the rolling element.

37. An installation according to claim 36 wherein the chain wheel and the rolling element are connected together or united as one integral compound.

38. An installation according to claim 22, wherein the guide channel for the guide shoe is of trapezoidal cross-section and the portion of the guide shoe and the ribs have corresponding inclined surfaces which confront one another.

39. An installation according to claim 22, wherein the other guide disposed on the side of the conveyor remote from the chain channel is composed of guide rails mounted on supports fixed onto the upper flanges of the side walls of the conveyor pans remote from the chain channel and the machine has one or more guide skids which engage with the guide rails.

* * * * *